US006086182A

United States Patent [19]

Nambudiri

[11] Patent Number: 6,086,182

[45] Date of Patent: Jul. 11, 2000

[54] MAILING MACHINE INCLUDING INK JET OPERATION CHECKING FOR PREVENTION OF LOSS OF POSTAL FUNDS

[75] Inventor: Eswaran C. Nambudiri, Port Chester, N.Y.

[73] Assignee: Pitney Bowes Inc., Stamford, Conn.

[21] Appl. No.: 09/372,330

[22] Filed: Aug. 11, 1999

Related U.S. Application Data

[63] Continuation of application No. 09/046,902, Mar. 24, 1998.

[51] Int. Cl.[7] ..... B41J 2/165; G03G 15/00

[52] U.S. Cl. ..... 347/23; 399/81

[58] Field of Search ..... 347/7, 14, 19, 347/23; 399/10, 15, 21, 24, 25, 27, 81

[56] References Cited

U.S. PATENT DOCUMENTS 5,663,750 9/1997 Sakuma ..... 347/7

5,850,583 12/1998 Song et al. ..... 399/24

5,856,834 1/1999 Murphy, III ..... 347/23

*Primary Examiner*—William Royer

*Assistant Examiner*—Hoang Ngo

*Attorney, Agent, or Firm*—Angelo N. Chaclas; Michael E. Melton

[57] ABSTRACT

An ink jet printing system includes a user interface for communicating messages between the ink jet printer and an operator and controller in operative communication with the user interface. The controller disables printing of certain information other than a test pattern in response to a predetermined event, generates a random message, prints a test pattern in response to a predetermined event, incorporates the generated random message within the test pattern, receives an indication of the random message from the operator, compares the received random message with the generated random message, and if the received random message equals the generated random message, enables printing of certain information other than the test pattern.

20 Claims, 4 Drawing Sheets

MAILING MACHINE INCLUDING INK JET OPERATION CHECKING FOR PREVENTION OF LOSS OF POSTAL FUNDS

This application is a continuation of Ser. No. 09/046,902, Mar. 24, 1998.

CROSS REFERENCE TO RELATED APPLICATIONS

This application is related to the following co-pending applications all commonly assigned to the assignee of this application: U.S. patent application Ser. No. 08/847,235 filed on May 1, 1997 and entitled DISABLING A PRINTING MECHANISM IN RESPONSE TO AN OUT OF INK CONDITION (E-599); U.S. patent application Ser. No. 08/864,942 filed on May 29, 1997 and entitled DISABLING A MAILING MACHINE WHEN A PRINT HEAD IS NOT INSTALLED (E-617); U.S. patent application Ser. No. 08/951,075 filed on Oct. 15,1997 and entitled MAILING MACHINE HAVING REGISTRATION OF MULTIPLE ARRAYS OF PRINT ELEMENTS (E-657) and U.S. patent application Ser. No. 08/960,872 filed on Oct. 30, 1997 and entitled MAILING MACHINE INCLUDING INK JET PRINTING HAVING INK JET AVAILABILITY CHECKING (E-680).

FIELD OF THE INVENTION

This invention relates to an ink jet printer including a disposable cartridge where the ink jet printer includes the capability of ensuring that the cartridge is functioning properly before beginning normal operations. More particularly, this invention is directed to a mailing machine including an ink jet printer having a disposable cartridge wherein the mailing machine prompts an operator to perform a test print in response to a predetermined event to determine if the cartridge is functioning properly so that postal funds are not lost.

BACKGROUND OF THE INVENTION

Ink jet printers are well known in the art. Generally, an ink jet printer includes an array of nozzles or orifices, a supply of ink, a plurality of thin channels connecting the array of nozzles with the ink supply, respectively, a plurality of ejection elements (typically either expanding vapor bubble elements or piezoelectric transducer elements) corresponding to the array of nozzles and suitable driver electronics for controlling the ejection elements. Typically, the array of nozzles and the ejection elements along with their associated components are referred to as a print head. It is the activation of the ejection elements that causes drops of ink to be expelled from the nozzles. The ink ejected in this manner forms drops which travel along a flight path until they reach a print medium such as a sheet of paper, overhead transparency, envelope or the like. Once they reach the print medium, the drops dry and collectively form a print image. Typically, the ejection elements are selectively activated or energized as relative movement is provided between the print head and the print medium so that a predetermined or desired print image is achieved.

Generally, the array of nozzles, supply of ink, plurality of ejection elements and driver electronics are packaged into a disposable cartridge. In turn, the printer includes a carriage assembly for detachably mounting the cartridge thereto. In this manner, a fresh cartridge may be installed when the ink supply of the current cartridge has been consumed. Some ink jet printers provide an indication to the user that the ink supply is running low while others do not. In either case, the printer continues to operate with the result being that the user must recognize when the ink supply is exhausted and install a fresh cartridge. Thus, it is generally intended for the cartridges to be disposable.

To keep an ink jet printer in proper working order, a variety of maintenance actions, such as capping, wiping, normal flushing, power flushing, normal purging and power purging, have been developed. Most of these maintenance actions are directed toward preventing the array of nozzles from becoming clogged with stale ink or other debris. When not in use, the print head is sealed off from ambient air by a cap. In this manner, the evaporation rate of any solvents or other volatiles contained within the ink is reduced and the ink is less prone to clumping. A wiper blade is typically employed to squeegee any excess ink or other debris off from the face plate of the array of nozzles. This cleaning action is typically performed both prior to capping and prior to printing. A normal flush involves firing each nozzle in the array of nozzles a predetermined number or times to expel ink that may be beginning to clump. A power flush is similar to a normal flush except that the number of time each nozzle is fired is substantially greater than that for a normal flush. A normal purge involves applying a vacuum for a predetermined amount of time to the array of nozzles to suck out ink. A power purge is similar to a normal purge except that the amount of time that the vacuum is applied is substantially greater than that for a normal purge.

Recently, the postage meter industry and other envelope printing industries have begun to incorporate ink jet printers. A typical postage meter (one example of a postage printing apparatus) applies evidence of postage, commonly referred to as a postal indicia, to an envelope or other mailpiece and accounts for the value of the postage dispensed. As is well known, postage meters include an ascending register, that stores a running total of all postage dispensed by the meter, and a descending register, that holds the remaining amount of postage credited to the meter and that is reduced by the amount of postage dispensed during a transaction. Because U.S. Postal Service regulations require that postage be paid in advance, it had traditionally been required that the user of a postage meter periodically present the meter to a Postal Service employee for recharging. However, more recently it is possible to recharge a meter remotely using telephone communications. At the time of recharging, the user paid to the Postal Service the amount of postage to be credited to the meter and the meter is recharged by increasing the setting of the descending register by the amount paid. The postage meter generally also includes a control sum register which provides a check upon the descending and ascending registers. The control sum register has a running account of the total funds being added into the meter. The control sum register must always correspond with the summed readings of the ascending and descending registers. The control sum register is the total amount of postage ever put into the machine and it is alterable only when adding funds to the meter. In this manner, the dispensing of postal funds may be accurately tracked and recorded.

Generally, the postage meter may be incorporated into a mailing machine, which is also well known in the art, for automated handling of the mailpieces. Mailing machines are readily available from manufacturers such as Pitney Bowes Inc. of Stamford, Conn., USA and often include a variety of different modules, which automate the processes of producing mailpieces. The typical mailing machine includes a variety of different modules or sub-systems where each module performs a different task on a mailpiece, such as:

singulating (separating the mailpieces one at a time from a stack of mailpieces), weighing, sealing (wetting and closing the glued flap of an envelope), applying evidence of postage, accounting for postage used (performed by the postage meter), feeding roll tape or cut tape strips for printing and stacking finished mailpieces. However, the exact configuration of each mailing machine is particular to the needs of the user. Customarily, the mailing machine also includes a transport apparatus, which feeds the mailpieces in a path of travel through the successive modules of the mailing machine.

Due to the inherent nature of printing an indicia of value (a postal indicia being the equivalent of money), several issues arise with utilizing ink jet printing in a postage printing device. For example, if a general purpose ink jet printer runs out of ink or malfunctions while printing a document, then the user merely installs a new cartridge and reprints the document. On the other hand, if a postage printing device runs out of ink or malfunctions while printing a postal indicia, then the user loses money because the postal funds associated with that postal indicia cannot be recovered. Therefore, it is desirable to ensure the proper functioning of the cartridge.

In some ink jet printers, it is known to print a test pattern after installing a fresh cartridge. Generally, the test pattern may serve as an indicator of the performance of the ink jet printer or may be used to register multiple print heads. However, the operator of the ink jet printer may disregard the test pattern by not printing it or by ignoring the results. If the operator bypasses or ignores the test print, then there is no assurance that the ink jet printer is functioning properly before normal operations resume.

Therefore, there is a need for a postage printing apparatus that prevents an operator from bypassing or ignoring a test pattern printed in response to a predetermined event, such as the installation of a fresh cartridge.

SUMMARY OF THE INVENTION

The present invention provides a closed loop check routine for ensuring the ink jet printer is in proper working order before certain information may be printed.

In conventional fashion, this invention may be incorporated into a variety of devices employing ink jet printing, such as: a general purpose ink or a postage printing system (mailing machine, postage meter, or the like)

In accordance with the present invention, there is provided an ink jet printing system comprising a user interface for communicating messages between the ink jet printer and an operator and controller in operative communication with the user interface. The controller disables printing of certain information other than a test pattern in response to a predetermined event, generates a random message, prints a test pattern in response to a predetermined event, incorporates the generated random message within the test pattern, receives an indication of the random message from the operator, compares the received random message with the generated random message, and if the received random message equals the generated random message, enables printing of certain information other than the test pattern.

Thus, the test pattern must be of sufficient quality and of sufficient unpredictable content. In this manner, the operator must and is able to discern the random message. Unless the random message is accurately read and entered, the ink jet printing system will not resume normal operations.

A method of operating an ink jet printing system is also provided.

Therefore, it is now apparent that the present invention substantially overcomes the disadvantages associated with the prior art. Additional advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PREFERRED EMBODIMENTS

Figure 1:
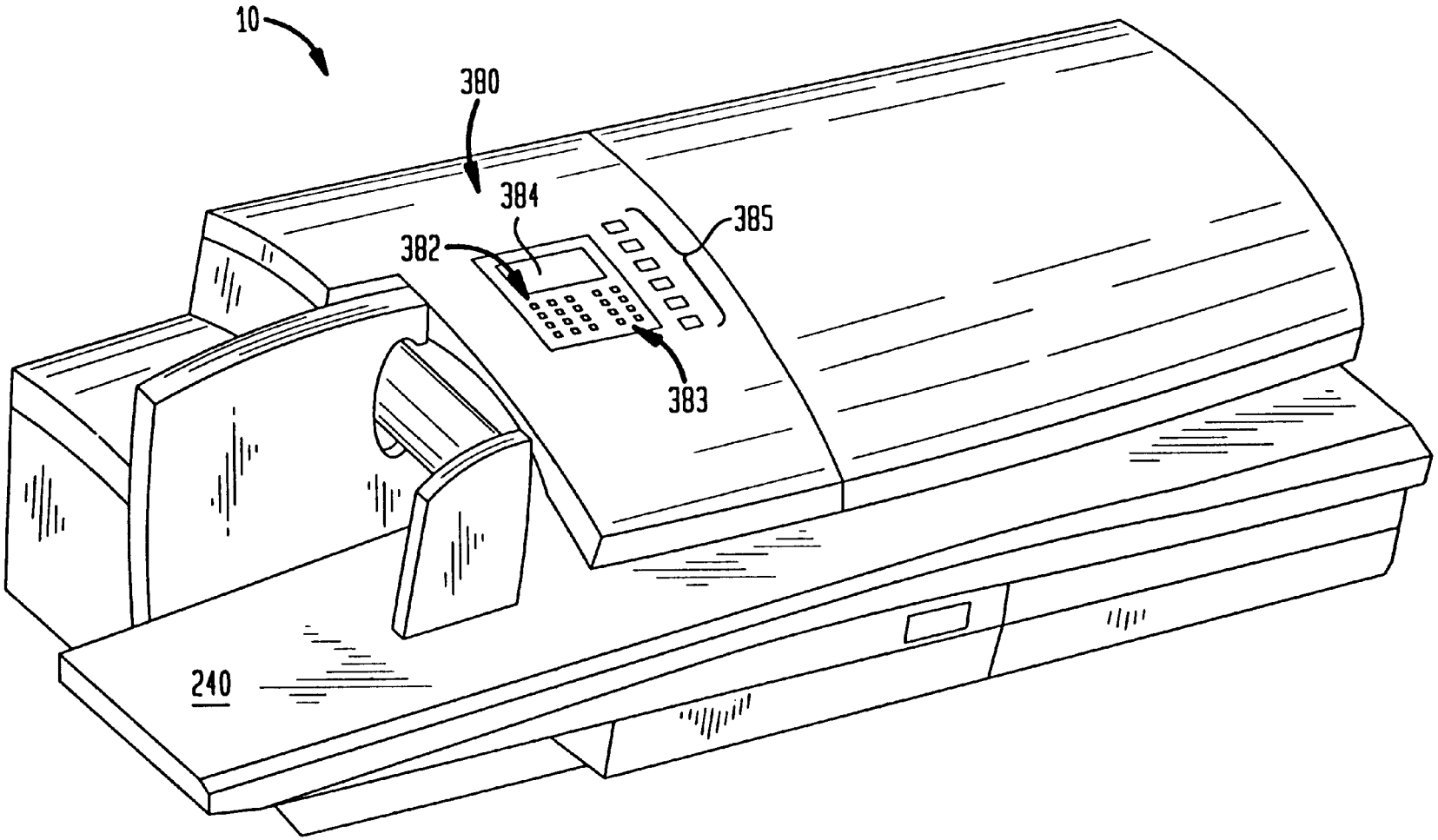
FIG. 1 is a simplified perspective view of a mailing machine that incorporates the present invention.

Referring to FIG. 1, a mailing machine 10 including a feed deck 240 and a user interface 380 is shown. The user interface 380 includes a numeric keypad 382, a set of keys 383, a display 384 (CRT, LED, LCD, or otherwise) and a set of function keys 385. The keys 383 provide access to a set of "soft" commands or functions, such as: enter, clear, download postage, generate report, account setup, diagnostics and the like. By soft commands, it is meant that these commands are not directly related to processing a batch oil mailpieces. In contrast, the function keys 385 provide access to a set of "hard" commands, such as: start, stop, print tape, reset batch counter, weigh mode on/off, sealer/moistener mode on/off and the like, which are directly related to processing a batch of mailpieces. Further details of the mailing machine 10 will be provided in the remaining Figures and the written text below.

Figure 2:
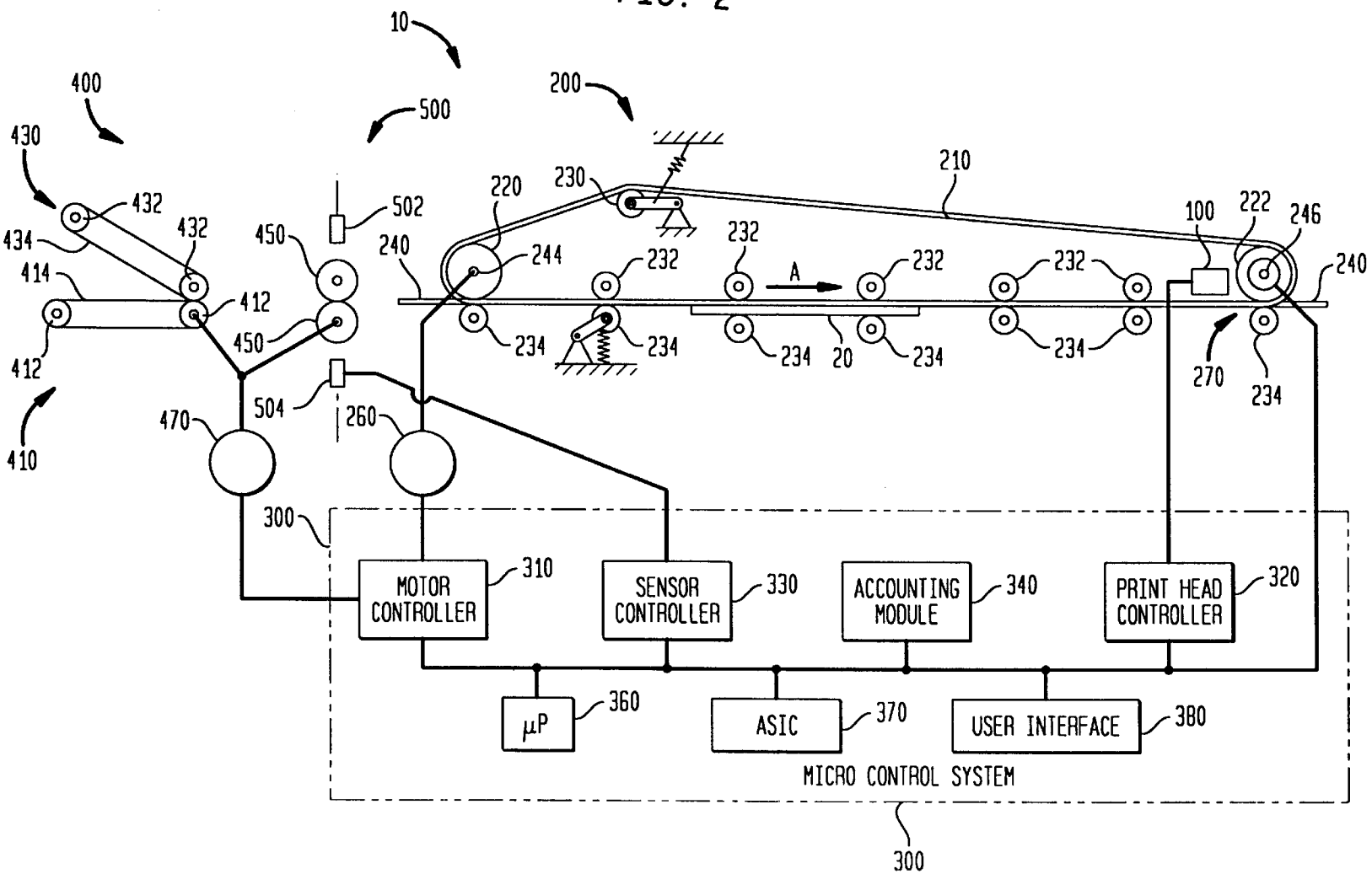
FIG. 2 is a simplified schematic of a front elevational view of a mailing machine which incorporates the present invention.

Referring to FIG. 2, an simplified schematic of an elevational view of the mailing machine 10 is shown. The mailing machine 10 includes a printer module 100, a conveyor apparatus 200, a micro control system 300 and a singulator module 400. Other modules of the mailing machine 10, such as those described above, have not been shown for the sake of clarity. The singulator module 400 receives a stack of envelopes (not shown), or other mailpieces such as postcards, folders and the like, and separates and feeds them in a seriatim fashion (one at a time) in a path of travel as indicated by arrow A. Downstream from the path of travel, the conveyor apparatus 200 feeds the envelopes 20 in the path of travel along the deck 240 past the printer module 100 so that a postal indicia can be printed on each envelope 20. Together, the singulator module 400 and the conveyor module 200 make up a transport apparatus for feeding the envelopes 20 through the various modules of the mailing machine 10.

The singulator module 400 includes a feeder assembly 410 and a retard assembly 430 which work cooperatively to separate a batch of envelopes (not shown) and feed them one at a time to a pair of take-away rollers 450. The feeder assembly 410 includes a pair of pulleys 412 having an endless belt 414 extending therebetween. The feeder assembly 410 is operatively connected to a motor 470 by any suitable drive train which causes the endless belt 414 to rotate clockwise so as to feed the envelopes in the direction indicated by arrow A. The retard assembly 430 includes a pair of pulleys 432 having an endless belt 434 extending therebetween. The retard assembly 430 is operatively connected to any suitable drive means (not shown) which causes the endless belt 434 to rotate clockwise so as to prevent the upper envelopes in the batch of envelopes from reaching the take-away rollers 450. In this manner, only the bottom envelope in the stack of envelopes advances to the take-away rollers 450. Those skilled in the art will recognize that the retard assembly 430 may be operatively coupled to the same motor as the feeder assembly 410.

The take-away rollers 450 are located adjacent to and downstream in the path of travel from the singulator module 400. The take-away rollers 450 are operatively connected to motor 470 by any suitable drive train (not shown). Generally, it is preferable to design the feeder assembly drive train and the take-away roller drive train so that the take-away rollers 450 operate at a higher speed than the feeder assembly 410. Additionally, it is also preferable that the take-away rollers 450 have a very positive nip so that they dominate control over the envelope 20. Consistent with this approach, the nip between the feeder assembly 410 and the retard assembly 430 is suitably designed to allow some degree of slippage.

The mailing machine 10 further includes a sensor module 500 which is substantially in alignment with the nip of take-away rollers 450 for detecting the presence of the envelope 20. Preferably, the sensor module 500 is of any conventional optical type which includes a light emitter 502 and a light detector 504. Generally, the light emitter 502 and the light detector 504 are located in opposed relationship on opposite sides of the path of travel so that the envelope 20 passes therebetween. By measuring the amount of light that the light detector 504 receives, the presence or absence of the envelope 20 can be determined. Generally, by detecting the lead and trail edges of the envelope 20, the sensor module 500 provides signals to the micro control system 300 which are used to determine the length of the envelope 20 and measure the gap between successive envelopes 20.

The conveyor apparatus 200 includes an endless belt 210 looped around a drive pulley 220 and an encoder pulley 222 which is located downstream in the path of travel from the drive pulley 220 and proximate to the printer module 100. The drive pulley 220 and the encoder pulley 222 are substantially identical and are fixably mounted to respective shafts (not shown) which are in turn rotatively mounted to any suitable structure (not shown) such as a frame. The drive pulley 220 is operatively connected to a motor 260 by any conventional means such as intermeshing gears (not shown) or a timing belt (not shown) so that when the motor 260 rotates in response to signals from the micro control system 300, the drive pulley 220 also rotates which in turn causes the endless belt 210 to rotate and advance the envelope 20 along the path of travel.

The conveyor apparatus 200 further includes a plurality of idler pulleys 232, a plurality of normal force rollers 234 and a tensioner pulley 230. The tensioner pulley 230 is initially spring biased and then locked in place by any conventional manner such as a set screw and bracket (not shown). This allows for constant and uniform tension on the endless belt 210. In this manner, the endless belt 210 will not slip on the drive pulley 220 when the motor 260 is energized and caused to rotate. The idler pulleys 232 are rotatively mounted to any suitable structure (not shown) along the path of travel between the drive pulley 220 and the encoder pulley 222. The normal force rollers 234 are located in opposed relationship and biased toward the idler pulleys 232, the drive pulley 220 and the encoder pulley 222, respectively.

As described above, the normal force rollers 234 work to bias the envelope 20 up against the deck 240. This is commonly referred to as top surface registration which is beneficial for ink jet printing. Any variation in thickness of the envelope 20 is taken up by the deflection of the normal force rollers 234. Thus, a constant space (the distance between the printer module 100 and the deck 240) is set between the envelope 20 and the printer module 100 no matter what the thickness of the envelope 20. The constant space is optimally set to a desired value to achieve quality printing. It is important to note that the deck 240 contains suitable openings (not shown) for the conveyor apparatus 200.

The sensor module 500, the singulator module 400, conveyor apparatus 200 and the printer module 100 are under the control of the micro control system 300 which may be of any suitable combination of microprocessors, firmware and software. The micro control system 300 includes a motor controller 310 which is in operative communication with the motors 260 and 470, a printer controller 320 which is in operative communication with the printer module 100, a sensor controller 330 which is in operative communication with the sensor module 500; an accounting module 340 for authorizing and accounting for the dispensing of postal funds; a microprocessor 360; a security application specific integrated circuit (ASIC) 370 and the user interface 380. The motor controller 310, the printer controller 320, the sensor controller 330, the accounting module 340 and other various components of the micro control system 300 are all in operative communication with each other over suitable communication lines. Generally, the microprocessor 360 coordinates the operation and communications between the various sub-systems of the mailing machine 10.

Figure 3:
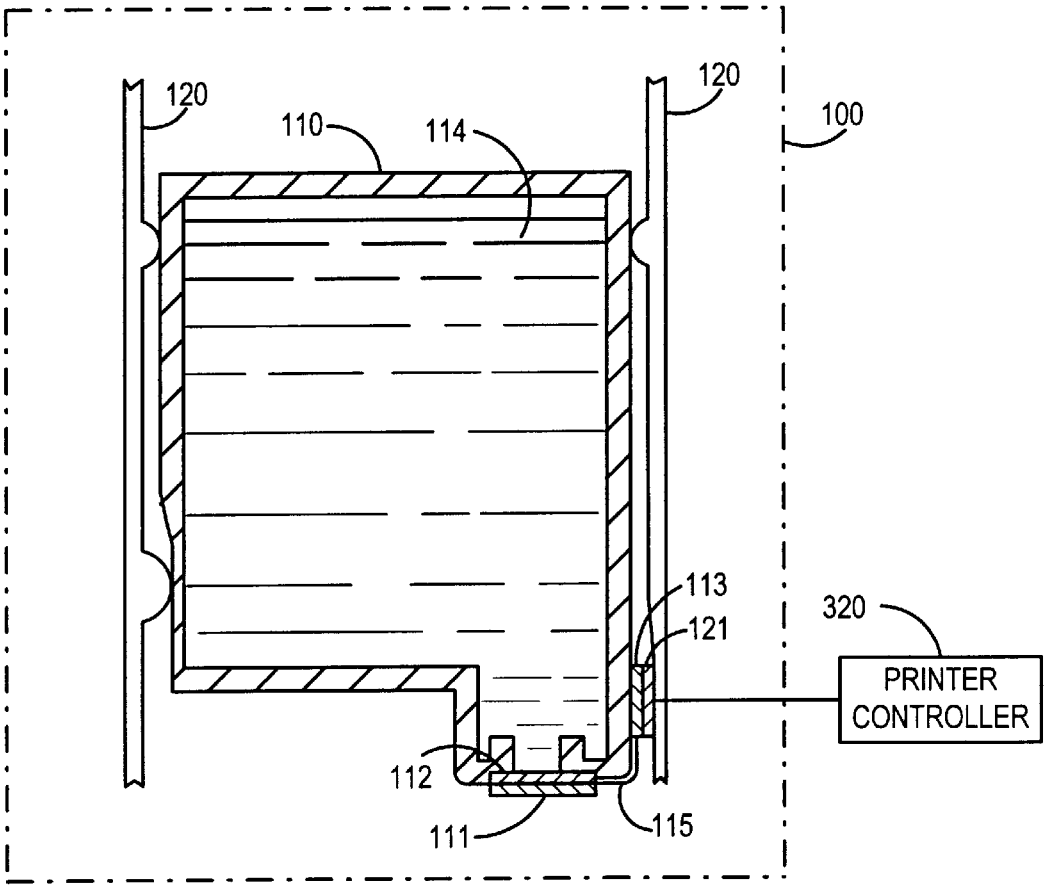
FIG. 3 is a simplified schematic of a sectional view of a printer module including a cartridge in accordance with the present invention.

Referring to FIG. 3, the printer module 100 is used for printing a postal indicia (not shown) on the envelope 20 (not shown). The printer module 100 includes a carriage 120 and a cartridge 110 detachably mounted to the carriage 120 in conventional fashion using any suitable structure (not shown). The cartridge 110 includes a nozzle plate 111 including an array of nozzles (not shown), an actuator plate 112 including a plurality of ejection elements (not shown) corresponding to the array of nozzles and an ink supply 114 in flowing communication with the actuator plate 112 and the nozzle plate 111. Additionally, the cartridge 110 includes a contact pad 113 detachably mounted to a corresponding contact pad 121 located on an exterior surface of the cartridge 110. The contact pad 113 is in operative communication with the actuator plate 112 via a flex strip 115. The contact pad 121 is in operative communication with the printer controller 320 so that the printer controller 320 may supply suitable drive signals to the actuator plate 112 of the cartridge 110.

The printer module 100 further includes a maintenance assembly (not shown) for capping and wiping the nozzle plate 111 and a repositioning assembly (not shown) for moving the carriage 120 and thus the cartridge 110 from a maintenance position to a print position. In the print position, the cartridge 110 is disposed above the path of travel of the envelope 20 (not shown) so that printing may occur.

Each cartridge 110 is initially filled with a predetermined amount of the ink 114. Since the ink 114 is used during printing and maintenance operations, the ink 114 will be gradually consumed over time and eventually a fresh cartridge 110 will need to be installed. To keep track of the amount of the ink 114 available, the printer controller 320 estimates an amount of the ink 114 used during all operations and subtracts this amount from the predetermined amount initially available to obtain an estimate of an amount of the ink 114 remaining. Any conventional technique for estimating ink can be used, such as counting individual ink drops or counting postal indicias and maintenance operations (each consuming an estimated amount of the ink 114), may be employed. In the alternative, an active system (not shown), such as a providing a thermistor in the ink reservoir, can be employed for actively measuring the amount of remaining ink.

Figure 4:
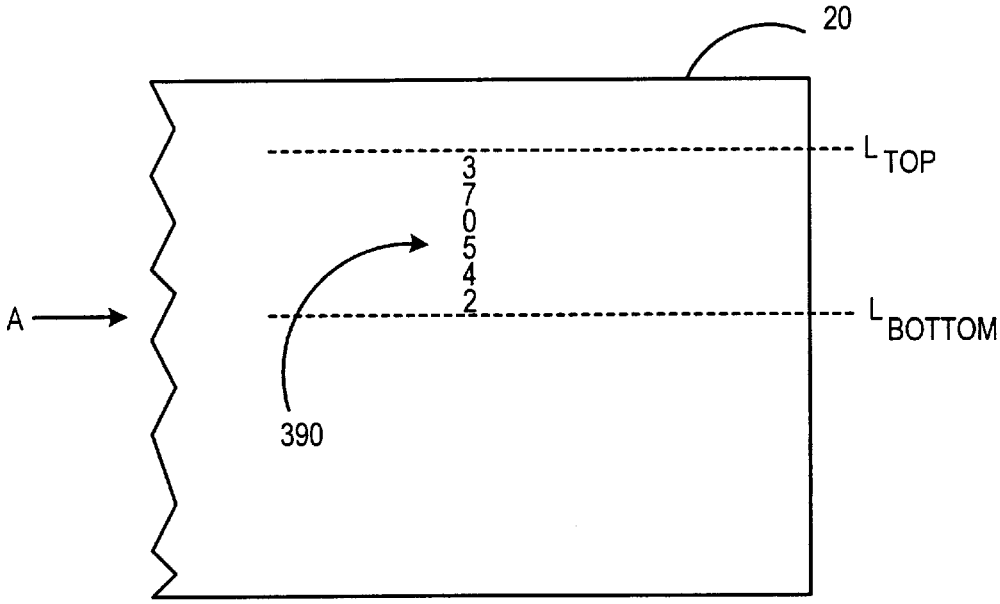
FIG. 4 is a plan of an envelope having a test pattern printed thereon in accordance with the present invention.

Referring to FIG. 4 in view of FIGS. 2 and 3, a test pattern 390 printed on the envelope 20 by the print module 100 is shown. The test pattern 390 spans the length of the array of nozzles (not shown), as identified by dashed lines $L_{top}$ and $L_{bottom}$, so that each nozzle must be utilized to complete the test pattern 390.

Figure 5:
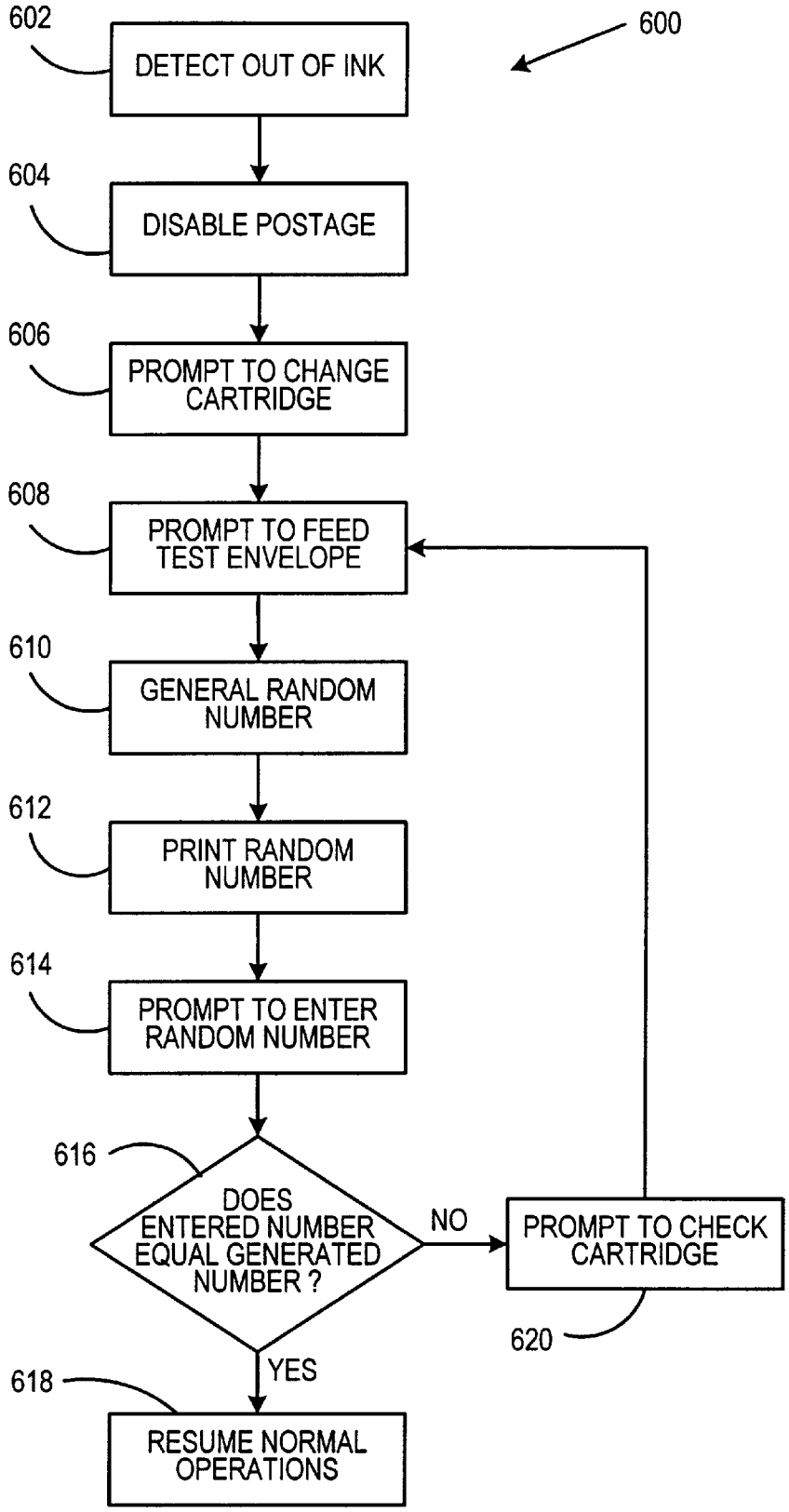
FIG. 5 is a flow chart showing the operation of the mailing machine in accordance with the present invention.

With the structure of the mailing machine 10 described as above, the operational characteristics will now be described. Referring primarily to FIG. 5, while referencing the structure of FIGS. 1, 2, 3 and 4, a flow chart of a check routine 600 indicating the operation of the mailing machine 10 in accordance with the present invention is shown. The check routine 600 represents a closed loop process for ensuring that the printer module 100 (more particularly the cartridge 110) is functioning properly before normal operations resume. Generally, the activities contained within the check routine 600 are coordinated by the micro control system 300 and more specifically at the supervision of the microprocessor 360.

At 602, when the print controller 320 determines that the amount of ink 114 remaining is less than or equal to threshold value, the micro control system 300 recognizes an out of ink condition. Next, at 604, the microprocessor 360 suspends operation of the accounting module 340 so that no postal funds may be dispensed and no postal indicia may be printed. In the alternative, the micro control system 300 may take any other action that has the effect of inhibiting printing of postage. However, the micro control system 300 may allow printing of other information, such as: reports & diagnostic results. Next, at 606, the operator is instructed via a message on the user interface 380 to install a fresh cartridge 110. Next, at 608, the operator is instructed via a message on the user interface 380 to feed a test envelope 20 through the mailing machine 10. Next, at 610, the microprocessor 360 generates a random number. Next, at 612, the random number is printed on the envelope 20 as the test pattern 390. Next, at 614, the operator is instructed to retrieve the envelope 20 having the test pattern 390 and to enter the random number into the mailing machine 10 using the keypad 382.

After the random number has been entered by the operator, a determination is made, at 616, whether or not the entered random number is the same as the generated random number. If yes, then at 618 normal operations resume. That is, operation of the accounting module 340 is established so that postal funds may be dispensed. On the other hand, if the answer is no, then at 620 the operator is instructed to check the cartridge 110 before control returns to 608.

It should now be apparent that the check routine 600 provides a safeguard against the unintentional loss of postal funds due to a malfunctioning print module 100. Basically, any problem that produces a poor quality test pattern 390 where the random number cannot be read legibly forces the operator to make any necessary corrections before continuing. Examples of the types of problems that the check routine 600 will help to address are: (i) failure of the operator to remove the protective cover over the nozzle plate 111 of a new cartridge 110; (ii) installation of a defective cartridge 110; (iii) failure of the operator to install the cartridge 110 properly in the carriage 120 so that the contact pads 113 and 121 are in proper mating relationship; (iv) installation of an empty or near empty cartridge 110; (v) clogged or malfunctioning nozzles within the cartridge 110; and (vi) failure of the operator to interrogate the test pattern 390 before staffing a batch run.

In the preferred embodiment, the failure of the comparison between the generated random number and the entered random number sets a flag in permanent memory that disables postage accounting and postage printing. This way, the operator cannot by-pass this routine 600 by power cycling the mailing machine 10. Thus, the comparison operation must be executed successfully.

In the preferred embodiment, the check routine 600 is performned upon replacement of the cartridge 110 in response to an out of ink condition. However, the check routine 600 with only slight modification may be run in response to other predetewmined events, such as: system power up/reboot; before each batch run; after a predetermined number of cycles; and/or at the request of the operator. Those skilled in the art will recognize that there exists great flexibility on when the check routine 600 is run and what portions of the check routine 600 need to be run.

In the preferred embodiment, the test pattern 390 is a random number generated by a suitable random number generator or obtained from a table of numbers (not shown) previously stored within the micro control system 300 by the mailing machine manufacturer. However, so long as the random number used within the test pattern 390 is not readily discernable by the operator and consecutive numbers are not the same, the random numbers may be obtained in any suitable manner. For example, the random number may be derived from register data and/or clock/calendar data.

As an extension of the basic concepts of the present invention, at 620, the operator may be prompted with a list of suggested corrective actions corresponding to those examples of the types of problems discussed above. In this manner, troubleshooting may be expedited. As a further extension, the operator may be prompted to perform a maintenance operation, such as a power purge, on the cartridge 110 before initiating the next test so that any clogged nozzles may be restored to proper working order.

As another extension of the basic concepts of the present invention, if the comparison between the entered random number and the generated random number fails a predetermined number of times before being successful, then the operator may be prompted to call customer technical support and the telephone number along with a diagnostic code may be displayed.

Many features of the preferred embodiment represent design choices selected to best exploit the inventive concept as implemented in a mailing machine. However, those skilled in the art will recognize that various modifications can be made without departing from the spirit of the present invention. For example, the preferred embodiments are described with respect to bubble jet technology where the print head and the ink supply are integrated within the cartridge 110. However, those skilled in the art will readily be able to adapt the inventive concepts of the present invention to other cartridge and print head configurations.

As another example, the preferred embodiments are described with respect to using a random number as the text pattern 390. This is because the typical mailing machine possess a full numeric keypad 382, but not a full alpha keypad. However, those skilled in the art will be able to adapt the inventive concepts of the present invention to utilize any suitable random message and data entry scheme. For instance, the test pattern 390 may be an alpha-numeric expression with other symbols included and the operator may be asked to choose the correct one from those presented on the display 384.

Therefore, the inventive concept in its broader aspects is not limited to the specific details of the preferred embodiments but is defined by the appended claims and their equivalents.

What is claimed is:

1. An ink jet printing system, comprising:

a user interface for communicating messages between the ink jet printing system and an operator; and a control system in operative communication with the user interface for conducting a test procedure in response to a predetermined event including:
disabling printing of certain information;
printing a message; and
receiving an indication of the message from the operator via the user interface.

2. The ink jet printing system of claim 1, further comprising:

a replaceable cartridge containing a supply of ink; and wherein:

the control system is further for:
comparing the received message indication with the message; and
if the received message indication does not equal the message, performing a maintenance operation on the replaceable cartridge.

3. The ink jet printing system of claim 2, wherein:

the control system is further for:
if the received message indication does not equal the message, prompting the operator to inspect the replaceable cartridge.

4. The ink jet printing system of claim 3, wherein:

the predetermined event is an out of ink condition.

5. The ink jet printing system of claim 4, wherein:

the control system is further for:
if the received message indication does not equal the message, conducting another test procedure using a subsequent message different from the message.

6. The ink jet printing system of claim 5, wherein:

the message and the subsequent message are random numbers.

7. The ink jet printing system of claim 6, wherein:

the control system is further for:
if the received message indication does not equal the message a predetermined number of times, instructing the operator to contact customer technical support.

8. The ink jet printing system of claim 7, wherein:

the ink jet printing system is a postage printing system; and the certain information other than the message is a postal indicia.

9. The ink jet printing system of claim 1, wherein:

the control system is further for:
if the received message indication does not equal the message, prompting the operator to inspect the ink jet printing system.

10. The ink jet printing system of claim 9, wherein:

the control system is further for:
comparing the received message indication with the message; and
if the received message indication does not equal the message, performing a maintenance operation on the ink jet printing system.

11. A method of operating an ink jet printing system, comprising the step(s) of:

providing a user interface for communicating messages between the ink jet printing system and an operator;

conducting a test procedure in response to a predetermined event including:
disabling printing of certain information;
printing a message; and
receiving an indication of the message from the operator via the user interface.

12. The method of claim 11, further comprising the step(s) of:

comparing the received message indication with the message; and if the received message indication does not equal the message, performing a maintenance operation on a replaceable cartridge containing a supply of ink.

13. The method of claim 12, further comprising the step(s) of:

if the received message indication does not equal the message, prompting the operator to inspect the replaceable cartridge.

14. The method of claim 13, wherein:

the predetermined event is an out of ink condition.

15. The method of claim 14, further comprising the step(s) of:

if the received message indication does not equal the message, conducting another test procedure using a subsequent message different from the message.

16. The method of claim 15, wherein:

the message and the subsequent message are random numbers.

17. The method of claim 16, further comprising the step(s) of:

if the received message indication does not equal the message a predetermined number of times, instructing the operator to contact customer technical support.

18. The method of claim 17, wherein:

the ink jet printing system is a postage printing system; and the certain information other than the message is a postal indicia.

19. The method of claim 11, further comprising the step(s) of:

if the received message indication does not equal the message, prompting the operator to inspect the ink jet printing system.

20. The method of claim 19, further comprising the step(s) of:

comparing the received message indication with the message; and if the received message indication does not equal the message, performing a maintenance operation on the ink jet printing system.

* * * * *